US008369979B2

(12) United States Patent
Weinzierl

(10) Patent No.: US 8,369,979 B2
(45) Date of Patent: Feb. 5, 2013

(54) METHOD OF OPERATION FOR A COOLING TRACK FOR COOLING A ROLLING PRODUCT, WITH COOLING TO AN END ENTHALPY VALUE UNCOUPLED FROM TEMPERATURE

(75) Inventor: Klaus Weinzierl, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 372 days.

(21) Appl. No.: 12/867,808

(22) PCT Filed: Feb. 11, 2009

(86) PCT No.: PCT/EP2009/051530

§ 371 (c)(1),
(2), (4) Date: Aug. 16, 2010

(87) PCT Pub. No.: WO2009/106423

PCT Pub. Date: Sep. 3, 2009

(65) Prior Publication Data

US 2010/0332015 A1 Dec. 30, 2010

(30) Foreign Application Priority Data

Feb. 27, 2008 (DE) ..... 10 2008 011 303

(51) Int. Cl.
*B21B 37/00* (2006.01)

(52) U.S. Cl. ..... 700/153; 148/511

(58) Field of Classification Search ..... 700/104, 700/147, 150, 153; 29/407.01, 407.05; 72/8.5; 703/2, 6; 62/62; 148/511
See application file for complete search history.

(56) References Cited

U.S. PATENT DOCUMENTS

| | | | | |
|---|---|---|---|---|
| 4,569,023 | A * | 2/1986 | Wakamiya | 700/153 |
| 5,357,443 | A * | 10/1994 | Watanbe et al. | 700/147 |
| 6,860,950 | B2 * | 3/2005 | Franz et al. | 148/503 |
| 6,866,729 | B2 * | 3/2005 | Gramckow et al. | 148/511 |
| 7,197,802 | B2 | 4/2007 | Kurz et al. | 29/407.01 |
| 7,251,971 | B2 | 8/2007 | Reinschke et al. | 72/8.5 |

(Continued)

FOREIGN PATENT DOCUMENTS

| | | |
|---|---|---|
| DE | 102004005919 | 9/2005 |
| EP | 1732716 | 9/2007 |

(Continued)

OTHER PUBLICATIONS

Written Opinion for International Application No. PCT/EP2009/051530 (6 pages), May 11, 2010.

*Primary Examiner* — Dave Robertson
(74) *Attorney, Agent, or Firm* — King & Spalding L.L.P.

(57) ABSTRACT

A control device for a cooling track for cooling a rolling product accepts at least partially characteristic information for a starting enthalpy value. The control device (8) determines a refrigerant volume progression (K) such that a heat volume corresponding to the difference between the starting enthalpy value (EA) and a prespecified end enthalpy value (EE) is removed from a rolling product segment (12) of the rolling product (5) during the movement of said rolling product through the cooling track (1). The control device (8) determines the refrigerant volume progression (K) independently of whether a prespecified end temperature value (TE) assigned to the end enthalpy value (EE) is reached at the end of application of refrigerant (6) to the rolling product (5). The control device (8) applies refrigerant (6) to the rolling product segment (12) during its passage through the cooling track (1) according to the determined refrigerant volume progression (K).

21 Claims, 5 Drawing Sheets

U.S. PATENT DOCUMENTS

| | | | | |
|---|---|---|---|---|
| 7,865,341 | B2 * | 1/2011 | Borchers et al. | 703/6 |
| 2007/0198122 | A1 | 8/2007 | Weinzierl | 700/147 |
| 2007/0276638 | A1 | 11/2007 | Borchers et al. | 703/6 |
| 2009/0265146 | A1 | 10/2009 | Franz et al. | 703/2 |
| 2009/0314873 | A1 * | 12/2009 | Schmid | 242/534 |
| 2010/0178486 | A1 * | 7/2010 | Ward et al. | 428/297.4 |

FOREIGN PATENT DOCUMENTS

| | | |
|---|---|---|
| WO | 0147647 | 7/2001 |
| WO | 03045599 | 6/2003 |
| WO | 2004076085 | 9/2004 |
| WO | 2007014831 | 2/2007 |

* cited by examiner

METHOD OF OPERATION FOR A COOLING TRACK FOR COOLING A ROLLING PRODUCT, WITH COOLING TO AN END ENTHALPY VALUE UNCOUPLED FROM TEMPERATURE

CROSS-REFERENCE TO RELATED APPLICATIONS

This application is a U.S. National Stage Application of International Application No. PCT/EP2009/051530 filed Feb. 11, 2009, which designates the United States of America, and claims priority to DE Application No. 10 2008 011 303.4 filed Feb. 27, 2008. The contents of which are hereby incorporated by reference in their entirety.

TECHNICAL FIELD

The present invention relates to an operating method for a cooling section for cooling a rolling stock.

The present invention furthermore relates to a computer program comprising machine code which can be executed directly by a control device for a cooling section for cooling a rolling stock. The present invention also relates to a data storage medium having such a computer program which is stored on the data storage medium in machine-readable form.

The present invention furthermore relates to a control device for a cooling section for cooling a rolling stock.

Finally, the present invention relates to a cooling section for cooling a rolling stock, the cooling section having a control device which operates the cooling section.

BACKGROUND

In a hot strip rolling mill or heavy plate rolling mill, steel is rolled. Material properties of the steel are substantially set in a downstream cooling section. For this purpose, a coolant is applied to the steel as the latter passes through the cooling section. This sets the temporal cooling profile of the steel passing through the cooling section. The material properties are also set on account of the temporal profile of the cooling operation.

The cooling profile is generally determined by a temporal temperature profile. Earlier strategies prescribe a distribution of the coolant quantity according to a predefined cooling strategy and a coiling temperature or final cooling temperature (i.e. the temperature of the rolling stock when the latter runs out of the cooling section). In the case of standard steels, this procedure is without problems. However, problems do arise in the case of steels with a high carbon content. This is because the stipulation of a temperature profile is unfavorable owing to the heat of transition which arises during the phase transition from austenite to ferrite and cementite. In many cases, it is even the case that only a final temperature to be reached is predefined in conjunction with a predefined cooling strategy. This type of stipulation can even be ambiguous, i.e. there is more than one solution for the water quantity with which the coiling temperature or the final cooling temperature is reached with a given cooling strategy. The material properties of the steels cooled differently in this way differ entirely, however.

In the case of steels with a high carbon content, fully automated operation is therefore not possible in the prior art. There are difficulties which arise repeatedly in practice when attempting to cool steels with a high carbon content in a fully automated manner. Material which does not have the desired material properties is repeatedly produced. These materials have to be remelted.

In practice, attempts are made to overcome the problems by trying to avoid such materials and stipulations. This reduces the producible spectrum of materials.

EP 1 732 716 B1 discloses an operating method for a cooling section for cooling a rolling stock, in which method the temperature of the rolling stock is detected on the input side of the cooling section. A quantitative coolant profile is determined, such that a rolling stock section, at a predefined point of the cooling section, is at a predetermined temperature and has at least one predetermined phase proportion (for example of austenite).

The above methods ultimately described already represent an improvement to the remaining prior art. However, they still do not work completely satisfactorily.

SUMMARY

According to various embodiments, possible ways can be provided to set desired material properties of the rolling stock in a simple, reliable and accurate manner.

According to an embodiment, in an operating method for a cooling section for cooling a rolling stock, a control device for the cooling section receives information which is at least partially characteristic for an initial enthalpy value, the control device determines a quantitative coolant profile such that a heat quantity corresponding to the difference between the initial enthalpy value and a predetermined final enthalpy value is taken from a rolling stock section of the rolling stock as it passes through the cooling section, the control device determines the quantitative coolant profile irrespective of whether a predetermined final temperature value assigned to the final enthalpy value is reached at the end of the application of a coolant to the rolling stock, and the control device applies the coolant to the rolling stock section as it passes through the cooling section in accordance with the determined quantitative coolant profile.

According to a further embodiment, the quantitative coolant profile can be determined as a function of the time. According to a further embodiment, the quantitative coolant profile may have an earlier time segment and a later time segment which follows the earlier time segment, the rolling stock section can be actively cooled during the earlier time segment by the application of the coolant, the rolling stock section may only cool passively during the later time segment without application of the coolant, and a temporal length of the earlier time segment can be determined in such a manner that at least one phase proportion of the rolling stock section, at the end of the earlier time segment, satisfies a predetermined condition. According to a further embodiment, the control device may receive information which is characteristic for the final enthalpy value. According to a further embodiment, the information which is characteristic for the final enthalpy value may comprise the final temperature value and at least one final phase proportion value. According to a further embodiment, the information which is at least partially characteristic for the initial enthalpy value may comprise an initial temperature value. According to a further embodiment, a temperature measuring device arranged on the input side of the cooling section may detect the initial temperature value, and the control device may receive the initial temperature value from the temperature measuring device. According to a further embodiment, an initial phase proportion value can be permanently predefined to the control device, or the control device may receive the initial phase proportion value from an operator of the cooling section or from an external device, or the control device may determine the initial phase proportion value. According to a further embodiment, the control device may determine a temperature and/or an enthalpy profile of the rolling stock section. According to a further embodiment, the control device may determine the temperature and/or enthalpy profile and at least one phase proportion profile in parallel, and takes the at least one determined phase proportion profile into account when determining the temperature and/or enthalpy profile. According to a further embodiment, the control device may use at least one of the determined profiles to determine at least one value which represents a measure for achieving a desired state of the rolling stock as it passes or after it has passed through the cooling section, and outputs this value to an operator of the cooling section. According to a further embodiment, the control device may use the determined temperature and/or enthalpy profile to determine a site or a point in time at which the rolling stock section has the final enthalpy value. According to a further embodiment, the predetermined final enthalpy value can be related to a predetermined site of the cooling section or to a predetermined point in time, the control device may compare the determined site with the predetermined site or the determined point in time with the predetermined point in time, and the control device may use the comparison to correct the quantitative coolant profile. According to a further embodiment, the predetermined final enthalpy value can be related neither to a predetermined site of the cooling section nor to a predetermined point in time.

According to another embodiment, a computer program may comprise machine code which can be executed directly by a control device for a cooling section for cooling a rolling stock, the execution of the machine code by the control device having the effect that the control device operates the cooling section in accordance with an operating method as described above.

According to yet another embodiment, a data storage medium may have a computer program as described above which is stored on the data storage medium in machine-readable form.

According to yet another embodiment, a control device for a cooling section for cooling a rolling stock can be designed in such a manner that it operates the cooling section in accordance with an operating method as described above.

According to a further embodiment of the control device, the control device may be in the form of a programmable control device which, during operation, executes a computer program as described above.

According to yet another embodiments, a cooling section for cooling a rolling stock may have a control device as described above, such that the cooling section is operated by the control device in accordance with an operating method as described above.

BRIEF DESCRIPTION OF THE DRAWINGS

Further advantages and details will emerge from the following description of exemplary embodiments in combination with the drawings, in which, in outline illustration.

DETAILED DESCRIPTION

Figure 1:
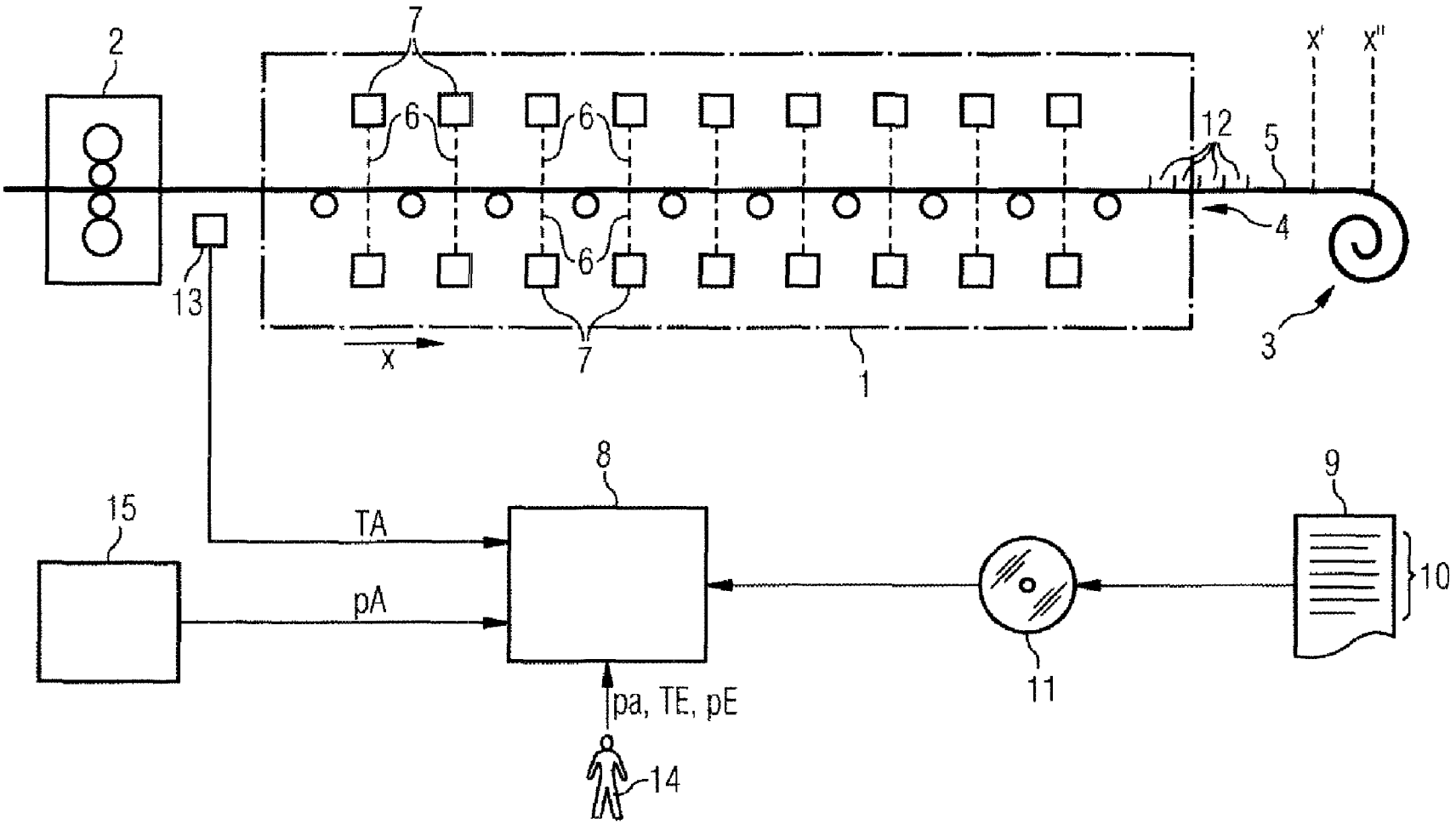
FIG. 1 schematically shows the design of a cooling section.

According to various embodiments, a control device for the cooling section receives information which is at least partially characteristic for an initial enthalpy value. The control device determines a quantitative coolant profile such that a heat quantity corresponding to the difference between the initial enthalpy value and a predetermined final enthalpy value is taken from a rolling stock section of the rolling stock as it passes through the cooling section. In this context, the control device determines the quantitative coolant profile irrespective of whether a predetermined final temperature value assigned to the final enthalpy value is reached at the end of the application of a coolant to the rolling stock. The control device applies the coolant to the rolling stock section as it passes through the cooling section in accordance with the determined quantitative coolant profile.

As a result of this procedure, the enthalpy is set as desired. The material properties of the rolling stock are thereby substantially defined.

The quantitative coolant profile is preferably determined as a function of the time. As a result of this procedure, the set material properties of the rolling stock are substantially independent of a speed at which the rolling stock passes through the cooling section.

In an embodiment, the quantitative coolant profile has an earlier time segment and a later time segment which follows the earlier time segment. The rolling stock section is actively cooled during the earlier time segment by the application of the coolant. The rolling stock section only cools passively during the later time segment without application of the coolant. A temporal length of the earlier time segment is determined in such a manner that at least one phase proportion of the rolling stock section, at the end of the earlier time segment, satisfies a predetermined condition. As a result of this procedure, both the predetermined final enthalpy value and, when the final enthalpy value is reached, the associated final temperature value are reached.

It is possible for the final enthalpy value to be permanently predefined to the control device. However, the control device preferably receives information which is characteristic for the final enthalpy value. In this case, the information which is characteristic for the final enthalpy value can comprise, in particular, the final temperature value and at least one final phase proportion value.

The information which is at least partially characteristic for the initial enthalpy value preferably comprises an initial temperature value. In this context, it is possible, in particular, for a temperature measuring device arranged on the input side of the cooling section to detect the initial temperature value, and for the control device to receive the initial temperature value from the temperature measuring device.

The initial enthalpy is generally determined completely only when at least one initial phase proportion value of the rolling stock is known together with the initial temperature. It is possible for the initial phase proportion value to be permanently predefined to the control device. Alternatively, the control device can receive the initial phase proportion value from an operator of the cooling section or from an external device. It is also possible for the control device to determine the initial phase proportion value.

The control device preferably determines a temperature and/or an enthalpy profile of the rolling stock section. This procedure makes it possible to determine the quantitative coolant profile particularly accurately. Even better results are obtained in this respect if the control device determines the temperature and/or enthalpy profile and at least one phase proportion profile in parallel, and takes the at least one determined phase proportion profile into account when determining the temperature and/or enthalpy profile. Since the temperature and/or enthalpy profile—and possibly also the phase proportion profile—are determined, it is possible, in particular, for the control device to use at least one of the determined profiles to determine at least one value which represents a measure for achieving a desired state of the rolling stock as it passes or after it has passed through the cooling section, and to output this value to an operator of the cooling section. By way of example, the control device can determine and output the enthalpy at the end of the cooling section or the temperature at which a desired degree of conversion is achieved. In the latter case, it may additionally be possible for a site and/or a point in time, at which this temperature is reached, to be output.

As an alternative or in addition, the control device can determine a site or a point in time at which the rolling stock section has the final enthalpy value. This also makes it possible to draw conclusions relating to the quality of the cooled rolling stock.

In an embodiment, the predetermined final enthalpy value is related to a predetermined site of the cooling section or to a predetermined point in time. In this case, it is possible for the control device to compare the determined site with the predetermined site or the determined point in time with the predetermined point in time, and to use the comparison to correct the quantitative coolant profile. A similar procedure is possible for other temperature or enthalpy values related to a predetermined site or a predetermined point in time.

Furthermore, it is possible to detect the temperature of the rolling stock at predetermined sites of the cooling section and to compare this with expected temperatures determined using the previously determined profile. In this case, the comparison can be used to adapt the expected temperature, the quantitative coolant profile or the method for determining the temperature from the quantitative coolant profile.

Alternatively, it is possible for the predetermined final enthalpy value to be related neither to a predetermined site of the cooling section nor to a predetermined point in time.

According to another embodiment, a computer program may comprise machine code which can be executed directly by a control device for a cooling section for cooling a rolling stock, the execution of the machine code by the control device having the effect that the control device operates the cooling section in accordance with an operating method of the type explained above. Furthermore, according to other embodiments, a data storage medium may store a computer program of this type in machine-readable form.

According to yet another embodiment, a control device for a cooling section for cooling a rolling stock may be designed in such a manner that it operates the cooling section in accordance with an operating method of the type described above. In this case, the control device can be, in particular, in the form of a programmable control device which, during operation, executes a computer program of the type described above.

According to other embodiments, a cooling section for cooling a rolling stock may have a control device of the type described above, such that the cooling section is operated by the control device in accordance with an operating method as described above.

As shown in FIG. 1, a cooling section 1 is generally arranged downstream from a hot-rolling mill train. Here, only the last rolling stand 2 of the hot-rolling mill train is shown in FIG. 1. In addition, a coiling arrangement 3 is generally arranged downstream from the cooling section 1.

The cooling section 1 has a roller table 4, in which a liquid coolant 6 (generally water with or without additions) is applied to a rolling stock 5 running out of the rolling mill train. For this purpose, the cooling section 1 has a multiplicity of coolant outlets 7, which can be controlled individually or in groups by a control device 8 for the cooling section 1. In this case, the control device 8 controls the entire cooling section 1, i.e. not only the coolant outlets 7 but also, for example, the cooling of rollers in the roller table 4.

The control device 8 is generally in the form of a programmable control device 8 which, during operation, executes a computer program 9. Here, the computer program 9 comprises machine code 10 which can be executed directly by the control device 8. In this case, the execution of the machine code 10 has the effect that the control device 8 operates the cooling section 1 in accordance with an operating method according to various embodiments.

The computer program 9 may already have been stored in the control device 8 during the production of the control device 8. Alternatively, it is possible to supply the computer program 9 to the control device 8 via a computer-computer link. The computer-computer link in this context is not shown in FIG. 1. By way of example, it may be in the form of a connection to a LAN or to the Internet. On the other hand, it is alternatively possible to store the computer program 9 on a data storage medium 11 in machine-readable form and to supply the computer program 9 to the control device 8 via the data storage medium 11. Here, the data storage medium 11 can have any desired design. By way of example, it is possible for the data storage medium 11 to be in the form of a USB memory stick or a memory card. In FIG. 1, the data storage medium 11 is in the form of a CD-ROM.

Figure 2:
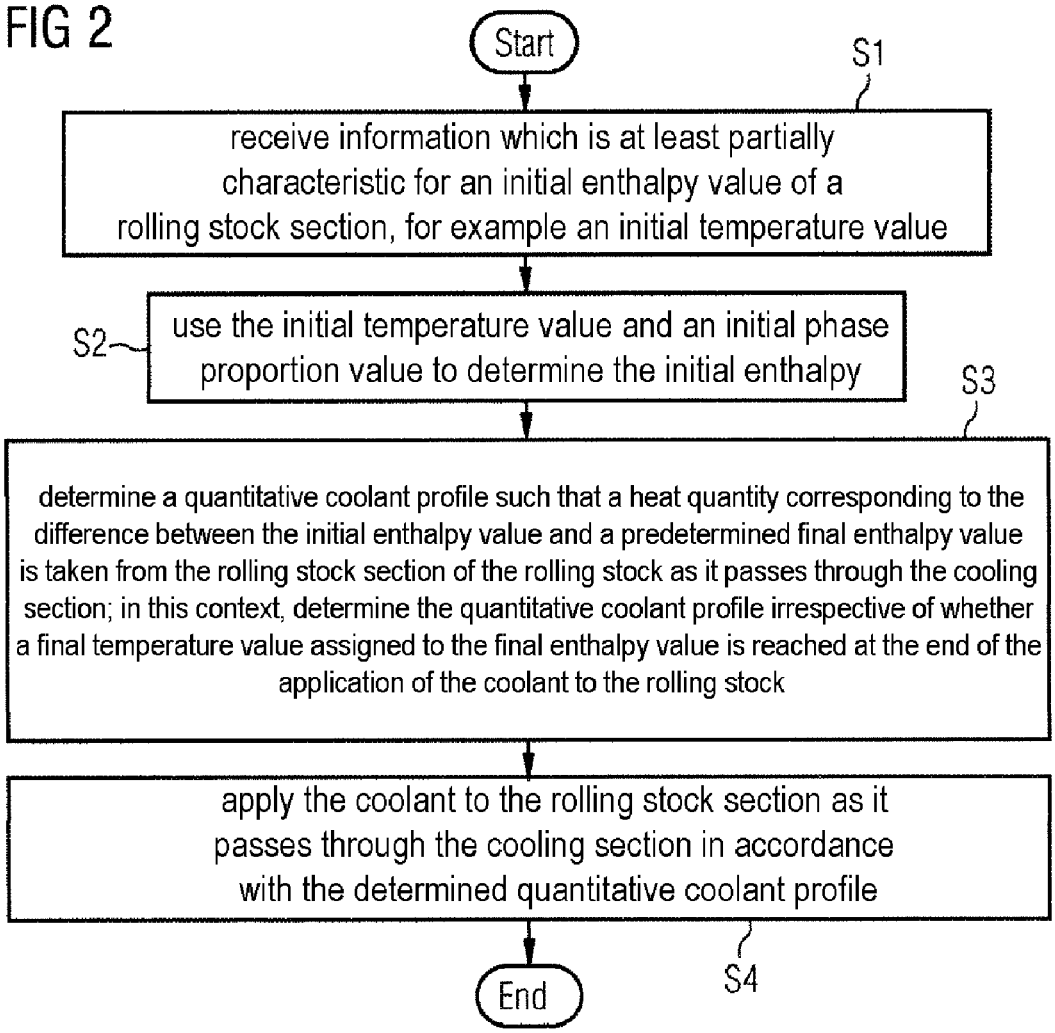
FIG. 2 shows a flow chart.

The operating method carried out by the control device 8 for the cooling section 1 is explained in more detail below in conjunction with FIG. 2. Beforehand, it should be pointed out in this respect that the operating method shown in FIG. 2 is carried out online, clocked and with displacement monitoring of the rolling stock 5. The procedure shown in FIG. 2 is therefore carried out for each individual section 12 of the rolling stock 5 monitored for displacement.

In a step S1, the control device 8 receives information TA which is at least partially characteristic for an initial enthalpy value EA of the rolling stock section 12. Here, the information TA which is at least partially characteristic for the initial enthalpy value EA generally comprises an initial temperature value TA.

In principle, the initial temperature value TA can be supplied to the control device 8 in any desired way. A temperature measuring device 13, which detects the initial temperature value TA and supplies it to the control device 8, is generally arranged on the input side of the cooling section 1 (see FIG. 1). Therefore, in this refinement, the control device 8 receives the initial temperature value TA from the temperature measuring device 13.

The initial enthalpy EA is often not yet clearly determined by the initial temperature TA alone. The initial enthalpy EA is generally additionally dependent on at least one initial phase proportion value pA. By way of example, the initial phase proportion value pA can be characteristic for the proportion of austenite in the rolling stock 5 or in the section 12 of the rolling stock 5 considered. Alternatively or in addition, an initial phase proportion value pA could be predefined, for example, for the proportion of ferrite or cementite.

In a step S2, the control device 8 uses the initial temperature value TA and the initial phase proportion value pA to determine the initial enthalpy EA. Here, the initial phase proportion value pA can be permanently predefined to the control device 8. Alternatively, it is possible (see FIG. 1) for the control device 8 to receive the initial phase proportion value pA from an operator 14 of the cooling section 1 or from an external device 15. In this context, the external device 15 may alternatively be a control device for the upstream hot-rolling mill train or a higher-level control device. On the other hand, it is alternatively possible for the control device 8 to automatically determine the initial phase proportion value pA.

In a step S3, the control device 8 determines a quantitative coolant profile K. Here, the control device 8 determines the quantitative coolant profile K in such a manner that a heat quantity corresponding to the difference between the initial enthalpy value EA and a predetermined final enthalpy value EE is taken from the rolling stock section 12 of the rolling stock 5 as it passes through the cooling section 1. In this context, the quantitative coolant profile K is generally a function of the time t (see FIG. 3). However, it is alternatively possible to determine the quantitative coolant profile K as a function of the site x in the cooling section 1.

Figure 4:
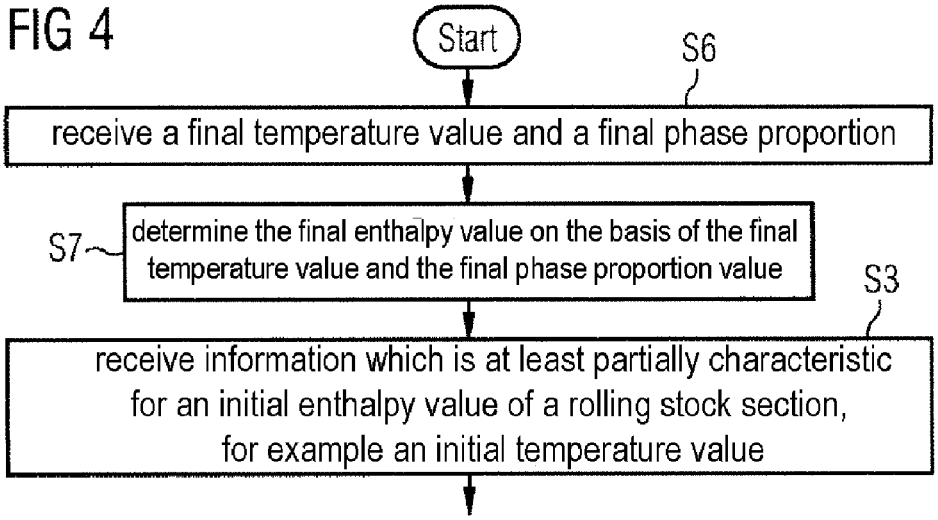
FIGS. 4 to 6 show flow charts.

A predetermined final temperature value TE is, at least generally, assigned to the final enthalpy value EE (see the details which follow in conjunction with FIG. 4). However, the control device 8 determines the quantitative coolant profile K irrespective of whether the final temperature value TE assigned to the final enthalpy value EE is reached at the end of the application of the coolant K to the rolling stock 5. All that is taken into consideration is whether the final enthalpy EE as such is reached. In a step S4, the control device 8 applies the coolant 6 to the rolling stock section 12 as it passes through the cooling section 1 in accordance with the determined quantitative coolant profile K. The appropriate application is readily possible here since the displacement of the rolling stock section 12 as it passes through the cooling section 1 is monitored.

Figure 3:
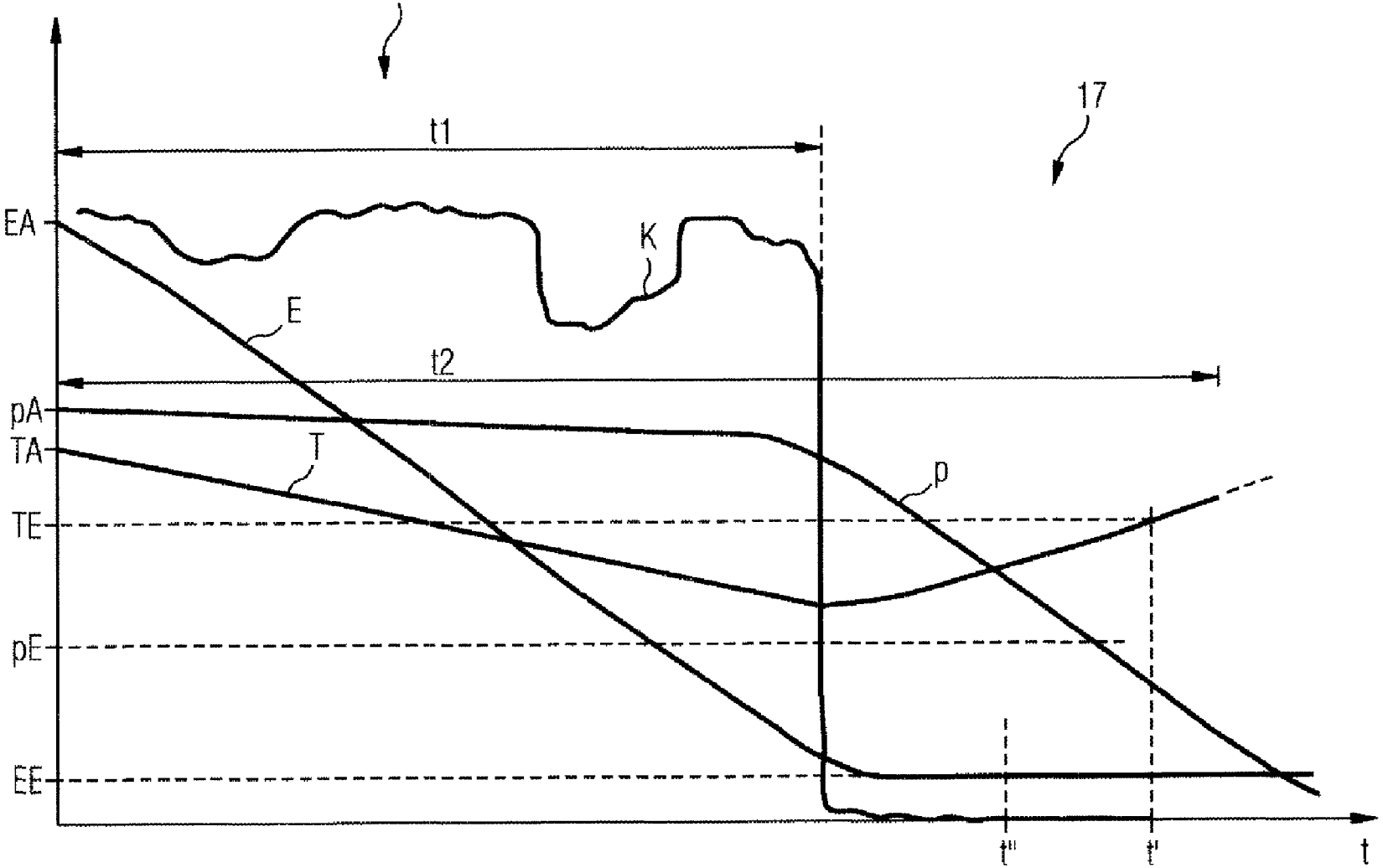
FIG. 3 shows a time diagram.

As can be seen from FIG. 3, the quantitative coolant profile K has an earlier time segment 16 and a later time segment 17. Here, the later time segment 17 immediately follows the earlier time segment 16. The rolling stock section 12 is actively cooled during the earlier time segment 16 by the application of the coolant 6. The rolling stock section 12 only cools passively during the later time segment 17. The coolant 6 is not applied during the later time segment 17.

The earlier time segment 16 has a temporal length t1. The temporal length t1 is determined in such a manner that it is less than a characteristic time constant t2 within which a phase transition of the rolling stock 5 takes place, for example from austenitic steel to ferritic steel. This has the effect that the phase transition of the rolling stock 5 has taken place only to a small extent at the end of the earlier time segment 16. Here, the extent to which the phase transition has taken place is dependent on the temporal length t1. Accordingly, it is possible to ensure, for example in the case of a steel rolling stock 5, that, at the end of the earlier time segment 16, the proportion of austenite in the rolling stock 5 is above a desired phase proportion or, conversely, the ferrite proportion is below a desired phase proportion, etc. It is generally possible to achieve a situation where at least one phase proportion of the rolling stock section 12, at the end of the earlier time segment 16, satisfies a predetermined condition.

In the later time segment 17, the enthalpy E of the relevant rolling stock section 12 decreases. However, the decrease in the enthalpy E takes place considerably more slowly than in the earlier time segment 16. During the later time segment 17, it can be regarded as substantially constant.

In the later time segment 17, the phase transition of the rolling stock 5 takes place, for example from austenite to ferrite and/or cementite. If the later time segment 17 is long enough, the austenite proportion generally drops to zero. In any case, however, the later time segment 17 should be long enough for the phase proportion p of the rolling stock 5 at the end of the later time segment 17 and the phase proportion p of the rolling stock 5 at the start of the later time segment 17 (i.e. at the end of the earlier time segment 16) to encompass the desired phase proportion. Irrespective of the point in time t and the site x at which the desired phase proportion is reached, a point in time t or a site x therefore exists at which

- the enthalpy E of the rolling stock section 12 is at least approximately equal to the final enthalpy value EE,
- the phase proportion p of the phase of the rolling stock 5 considered adopts the desired phase proportion, and consequently
- the temperature T of the rolling stock 5 is equal to the final temperature TE at this point in time t or at this site x of the cooling section 1.

If the later time segment 17 is sufficiently long for the desired phase proportion to be reliably encompassed by the phase proportion p at the start and at the end of the later time segment 17, the later time segment 17 may be followed by a further time segment, in which the coolant 6 is again applied to the rolling stock section 12. The further time segment is not shown in FIG. 3. As already mentioned, the final enthalpy value EE has to be specified. It is possible for the final enthalpy value EE to be permanently predefined to the control device 8. However, it is preferable for the final enthalpy value EE or information TE, pE which is characteristic for the final enthalpy value EE to be predefined to the control device 8, i.e. the control device 8 receives the corresponding values TE, pE. In this context, it is possible to directly predefine the final enthalpy value EE to the control device 8 as such. However, it is preferable, as shown in FIG. 4, for steps S6 and S7 to be carried out before step S1 (shown in FIG. 2). In step S6, the control device receives the final temperature value TE and a final phase proportion pE. The final temperature value TE and the final phase proportion value pE characterize the state of the rolling stock 5 completely. It is therefore possible, in step S7, to determine the final enthalpy value EE on the basis of the values TE and pE. If predefined, the final phase proportion value pE corresponds to the desired phase proportion mentioned above.

The above-described procedure is already feasible. Although it still does not lead to an optimal result, it already produces very good results. In particular, it produces reproducible results.

Figure 5:
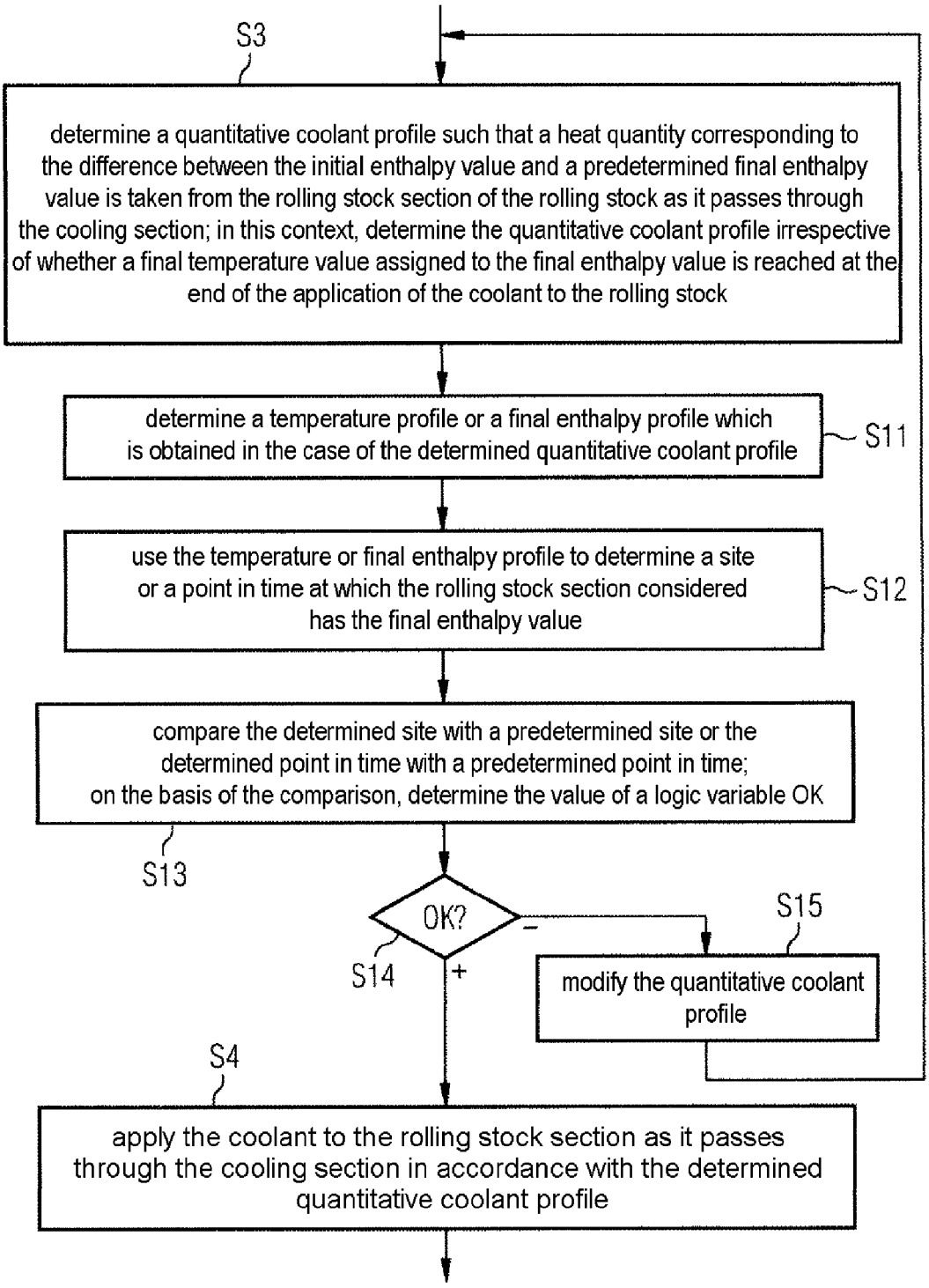

According to an embodiment, step S3 in FIG. 2 is modified in accordance with FIG. 5.

According to FIG. 5, in step S3 the control device 8 firstly determines the quantitative coolant profile K.

In a step S11, the control device 8 determines a temperature profile T—for example using a cooling-section model known per se (cf. for example DE 101 29 565 A1)—which is obtained in the case of the quantitative coolant profile K determined in step S3. As an alternative to determining the temperature profile T, a corresponding enthalpy profile E could be determined in step S11. Here, the determined profile T, E can alternatively be a function of the site x or a function of the time t. The determined profile T, E is preferably a function of the time t. Proceeding from step S11, it is possible to pass directly to step S4 and to apply the coolant 6 to the rolling stock section 12 in accordance with the determined quantitative coolant profile K. According to an embodiment, however, at least a step S12 is present. In step S12, the control device 8 uses the determined temperature or enthalpy profile T, E to determine a site x' or a point in time t' at which the rolling stock section 12 considered has the final enthalpy value EE. In this context, the site x' is determined if the determined profile T, E is a function of the site x, and the point in time t' is determined if the determined profile T, E is a function of the time t.

In a step which follows step S12 and is not shown in FIG. 5, it is possible merely to output the determined site x' or the determined point in time t' to the operator 14 and to await their reaction. This procedure is expedient particularly when the predetermined final enthalpy value EE is related neither to a predetermined site of the cooling section 1 nor to a predetermined point in time. However, the predetermined final enthalpy value EE is generally related to a predetermined site x" of the cooling section 1 or to a predetermined point in time t". By way of example, the predetermined site x" can be the site of the coiling arrangement 3. By way of example, the predetermined point in time t" may lie a predetermined number of seconds after the rolling stock section 12 considered runs into the cooling section 1.

If the final enthalpy value EE is related to the predetermined site x" or to the predetermined point in time t", steps S13 to S15 are preferably present. In step S13, the control device 8 compares the determined site x' with the predetermined site x" or the determined point in time t' with the predetermined point in time t". On the basis of the comparison, the control device 8 determines the value of a logic variable OK in step S13. By way of example, the logic variable OK can assume the value "TRUE" when, and only when, a (possibly signed) deviation of the predetermined site x" from the determined site x' lies within a predefined tolerance range. An analogous procedure can of course be adopted when comparing the determined point in time t' and the predetermined point in time t". In step S14, the control device 8 checks the value of the logic variable OK. If the logic variable OK has the value "TRUE", the control device 8 passes to step S4. Otherwise, the control device 8 executes step S15, in which it modifies the quantitative coolant profile K.

Figure 6:
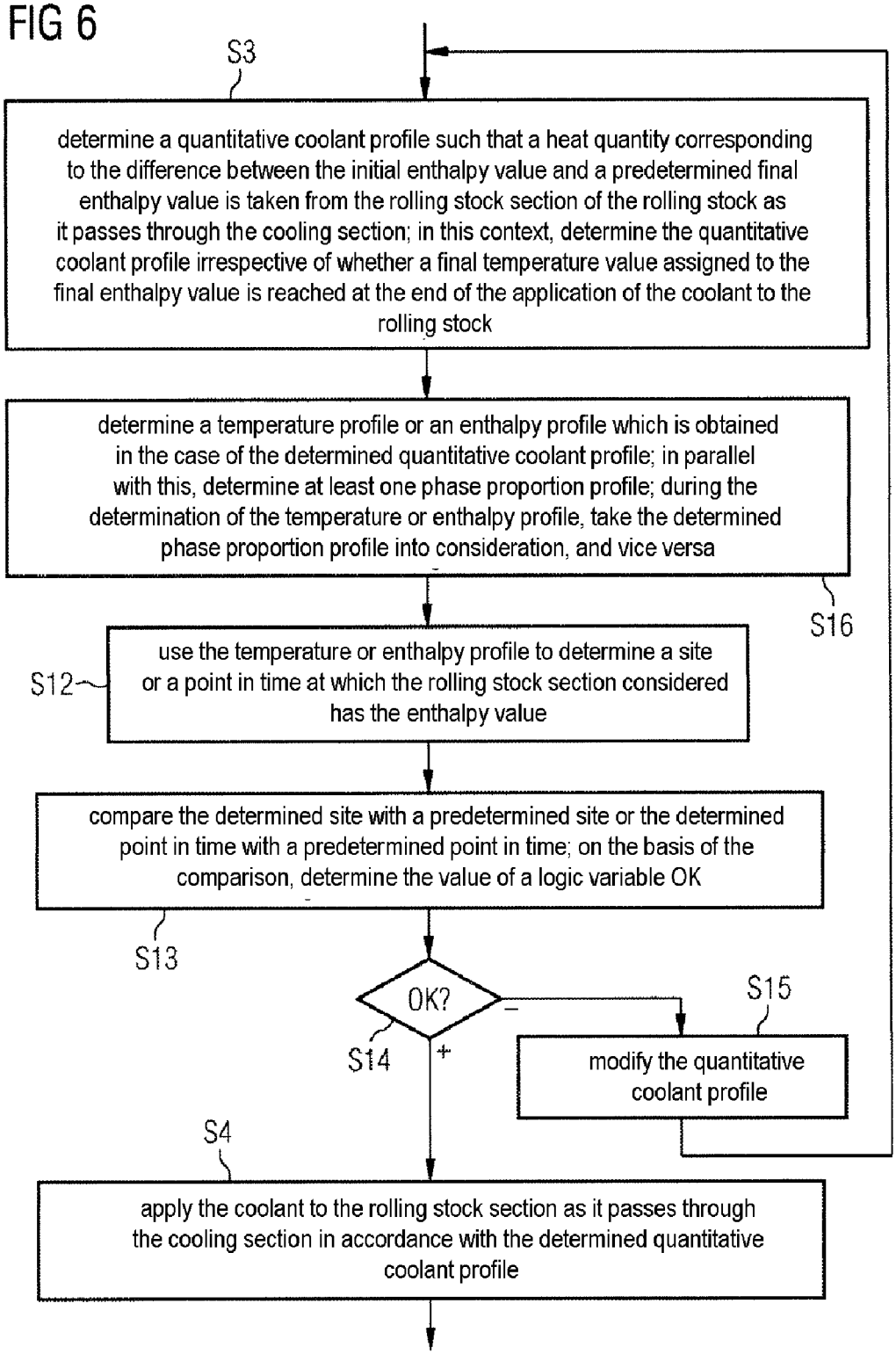

Within the context of FIG. 5, merely the temperature or the enthalpy profile T, E is determined. As shown in FIG. 6, the procedure of FIG. 5 can be improved even further by replacing step S11 with a step S16. In step S16—analogously to step S11—the control device 8 determines the temperature or the enthalpy profile T, E of the respective rolling stock section 12. In parallel with this, however, in step S16 the control device 8 determines at least one phase proportion profile p. During the determination of the temperature or enthalpy profile T, E, the control device 8 takes the determined phase proportion profile p into consideration, and vice versa.

The procedure of step S16 is generally known as such to experts. Purely by way of example, reference is made to DE 101 29 565 A1 (already mentioned).

The various embodiments have many advantages. By way of example, it is very simple to implement since the model of the cooling section 1 can be kept very rudimentary. It is not absolutely necessary to solve a complicated heat conduction equation (possibly including a phase transition equation). Nevertheless, good and above all reproducible regulation methods are obtained. The operating method always results in a clear quantitative coolant profile K and thus solves, in particular, all problems which arise in the case of carbon-rich steels in the prior art.

A further advantage of the various embodiments resides in the fact that the exact site at which the final enthalpy value EE is reached does not necessarily have to be calculated (even if this is advantageous). Furthermore, the site at which the rolling stock 5 assumes the final temperature value TE assigned to the final enthalpy EE also does not have to be calculated or satisfied. This is because the enthalpy E of the rolling stock section 12 considered remains substantially constant after the active cooling has finished (in the earlier time segment 16), and therefore the rolling stock section 12 considered reaches the final temperature TE at any point in time and therefore also at any site.

A further advantage of the various embodiments resides in the fact that the operator 14 does not have to directly predefine the final enthalpy EE, but instead can predefine the values with which he is familiar (the final temperature TE and final phase proportion value pE).

The above description serves exclusively to explain the present invention. However, the scope of protection of the present invention is intended to be determined exclusively by the appended claims.

What is claimed is:

1. An operating method for a cooling section for cooling a rolling stock, comprising:

receiving by a control device for the cooling section information which is at least partially characteristic for an initial enthalpy value, receiving by the control device a final temperature value and at least one final phase proportion value and determining a final enthalpy value therefrom, determining by the control device a quantitative coolant profile such that a heat quantity corresponding to the difference between the initial enthalpy value and final enthalpy value is taken from a rolling stock section of the rolling stock as it passes through the cooling section, determining by the control device the quantitative coolant profile irrespective of whether the final temperature value is reached at the end of the application of a coolant to the rolling stock, applying by the control device the coolant to the rolling stock section as it passes through the cooling section in accordance with the determined quantitative coolant profile.

2. The operating method according to claim 1, wherein the quantitative coolant profile is determined as a function of the time, the quantitative coolant profile has an earlier time segment and a later time segment which immediately follows the earlier time segment, the rolling stock section is actively cooled during the earlier time segment by the application of the coolant, and only cools passively during the later time segment without application of the coolant, and wherein a temporal length of the earlier time segment is determined in such a manner that at least one phase proportion of the rolling stock section, at the end of the earlier time segment, lies above the final phase proportion if the phase proportion decreases over time, and lies below the final phase proportion if the phase proportion increases over time.

3. The operating method according to claim 2, wherein the length of the later time segment is determined in such a manner that the phase proportion of the rolling stock at the start of the later time segment and the phase proportion of the rolling stock at the end of the later time segment encompass the final phase proportion.

4. The operating method according to claim 1, wherein the information which is at least partially characteristic for the initial enthalpy value comprises an initial temperature value.

5. The operating method according to claim 1, wherein an initial phase proportion value is permanently predefined to the control device, or in that the control device receives the initial phase proportion value from an operator of the cooling section or from an external device, or in that the control device determines the initial phase proportion value.

6. The operating method according to claim 1, wherein the control device determines at least one of a temperature and an enthalpy profile of the rolling stock section.

7. The operating method according to claim 6, wherein the control device determines at least one of the temperature and enthalpy profile and at least one phase proportion profile in parallel, and takes the at least one determined phase proportion profile into account when determining at least one of the temperature and enthalpy profile.

8. The operating method according to claim 6, wherein the control device uses at least one of the determined temperature and enthalpy profile to determine a site or a point in time at which the rolling stock section has the final enthalpy value.

9. The operating method according to claim 8, wherein the predetermined final enthalpy value is related to a predetermined site of the cooling section or to a predetermined point in time, in that the control device compares the determined site with the predetermined site or the determined point in time with the predetermined point in time, and in that the control device uses the comparison to correct the quantitative coolant profile.

10. The operating method according to claim 1, wherein the predetermined final enthalpy value is related neither to a predetermined site of the cooling section nor to a predetermined point in time.

11. A computer program product comprising a computer readable medium storing machine code which when executed by a control device for a cooling section for cooling a rolling stock, the execution of the machine code causes a control device for the cooling section to receive information which is at least partially characteristic for an initial enthalpy value, the control device to receive a final temperature value and at least one final phase proportion value and to determine a final enthalpy value therefrom, the control device to determine a quantitative coolant profile such that a heat quantity corresponding to the difference between the initial enthalpy value and final enthalpy value is taken from a rolling stock section of the rolling stock as it passes through the cooling section, the control device to determine the quantitative coolant profile irrespective of whether the final temperature value is reached at the end of the application of a coolant to the rolling stock, and the control device to apply the coolant to the rolling stock section as it passes through the cooling section in accordance with the determined quantitative coolant profile.

12. The computer program product according to claim 11 wherein the quantitative coolant profile is determined as a function of the time, the quantitative coolant profile has an earlier time segment and a later time segment which immediately follows the earlier time segment, the rolling stock section is actively cooled during the earlier time segment by the application of the coolant, and only cools passively during the later time segment without application of the coolant, and wherein a temporal length of the earlier time segment is determined in such a manner that at least one phase proportion of the rolling stock section, at the end of the earlier time segment, lies above the final phase proportion if the phase proportion decreases over time, and lies below the final phase proportion if the phase proportion increases over time.

13. A control device for a cooling section for cooling a rolling stock, the control device being configured to receive information which is at least partially characteristic for an initial enthalpy value, receive a final temperature value and at least one final phase proportion value and to determine a final enthalpy value therefrom, determine a quantitative coolant profile such that a heat quantity corresponding to the difference between the initial enthalpy value and final enthalpy value is taken from a rolling stock section of the rolling stock as it passes through the cooling section, to determine the quantitative coolant profile irrespective of whether the final temperature value is reached at the end of the application of a coolant to the rolling stock, to apply the coolant to the rolling stock section as it passes through the cooling section in accordance with the determined quantitative coolant profile.

14. The control device according to claim 13, wherein the control device is further configured to determine the quantitative coolant profile as a function of the time, wherein the quantitative coolant profile has an earlier time segment and a later time segment which immediately follows the earlier time segment, to actively cool the rolling stock section during the earlier time segment by the application of the coolant, and to only cool passively during the later time segment without application of the coolant, and wherein the control device determines a temporal length of the earlier time segment in such a manner that at least one phase proportion of the rolling stock section, at the end of the earlier time segment, lies above the final phase proportion if the phase proportion decreases over time, and lies below the final phase proportion if the phase proportion increases over time.

15. The control device according to claim 14, wherein the control device determines the length of the later time segment in such a manner that the phase proportion of the rolling stock at the start of the later time segment and the phase proportion of the rolling stock at the end of the later time segment encompass the final phase proportion.

16. The control device according to claim 13, wherein the information which is at least partially characteristic for the initial enthalpy value comprises an initial temperature value.

17. The control device according to claim 13, wherein an initial phase proportion value is permanently predefined to the control device, or in that the control device receives the initial phase proportion value from an operator of the cooling section or from an external device, or in that the control device determines the initial phase proportion value.

18. The control device according to claim 13, wherein the control device determines at least one of a temperature and an enthalpy profile of the rolling stock section.

19. The control device according to claim 18, wherein the control device determines at least one of the temperature and enthalpy profile and at least one phase proportion profile in parallel, and takes the at least one determined phase proportion profile into account when determining at least one of the temperature and enthalpy profile.

20. The control device according to claim 13, wherein the control device is a programmable control device which, during operation, executes a computer program.

21. A cooling section for cooling a rolling stock, the cooling section having a control device according to claim 13, such that the cooling section is operated by the control device.

* * * * *